United States Patent [19]

Hanyu et al.

[11] Patent Number: 4,572,090

[45] Date of Patent: Feb. 25, 1986

[54] SNAP FIT WORKPIECE EDGE GUIDE FOR A SEWING MACHINE

[75] Inventors: Susumu Hanyu; Akio Koide, both of Tokyo; Koji Kanemaki, Fukui, all of Japan

[73] Assignee: Janome Sewing Machine Industry Co., Ltd., Japan

[21] Appl. No.: 681,360

[22] Filed: Dec. 13, 1984

[30] Foreign Application Priority Data

Dec. 15, 1983 [JP] Japan ..... 58-192149[U]

[51] Int. Cl.[4] ..... D05B 35/10

[52] U.S. Cl. ..... 112/153; 83/743; 271/248

[58] Field of Search ..... 33/485, 490, 427, 428, 33/448; 83/743, 745; 271/248, 249, 250, 251, 252, 253; 112/153, 152, 136

[56] References Cited

U.S. PATENT DOCUMENTS 2,876,721 3/1959 Burke ..... 112/153 X
4,077,292 3/1978 Cole ..... 83/745

FOREIGN PATENT DOCUMENTS 1442177 5/1966 France ..... 112/153

OTHER PUBLICATIONS

IBM Tech. Disc. Bull., Gilleland et al., *Paper Feed Direction Adjustment,* vol. 22, No. 8b, Jan. 1980.

*Primary Examiner*—Werner H. Schroeder
*Assistant Examiner*—Andrew M. Falik
*Attorney, Agent, or Firm*—William A. Drucker

[57] ABSTRACT

A detachable and slideable fabric guide is used in combination with a sewing machine and adapted to bridge a sewing machine bed of a certain width, the fabric guide comprising an elongated main body made of an elastic material with sides which comprise vertical opposite faces, at least one of which is used to contact a fabric edge during stitching operation. The opposite ends of the main body are respectively curved down to integrally form hook portions which are, terminated with opposite abutments or grips each extending laterally of the main body. The opposite abutments normally define therebetween a predetermined distance a little smaller than the width of the sewing machine bed, which distance may be enlarged due to an outward flexing of the hook portions. One of the vertical faces of the main body is provided with a pair of walls protruding laterally therefrom to define therebetween a groove extending the substantial length of the elongated body.

2 Claims, 7 Drawing Figures

SNAP FIT WORKPIECE EDGE GUIDE FOR A SEWING MACHINE

BACKGROUND OF THE INVENTION

This invention relates to a sewing machine in general, and more particularly to a fabric guide used in combination with a sewing machine.

In stitching operation with a sewing machine a fabric guide is often needed. Such a fabric guide is preferably set on a sewing machine bed so as to define a face adapted to contact and guide the edge of a fabric material to be sewn as the fabric is transported in the fabric feed direction. Hitherto, it has been required that the guide is directly screwed to the sewing machine bed so that the installation and removal of the guide has been so troublesome and time-consuming. Further, it has been rather difficult to determine the distance between the needle position and the guide face of the fabric guide while the parallelism is maintained between the fabric guide and the fabric feed direction.

SUMMARY OF THE INVENTION

An object of the present invention is therefore to eliminate defects and disadvantages that have been encountered in the prior art and thereby to provide a novel fabric guide for a sewing machine which is easy to install on a sewing machine bed and remove therefrom.

Another object of the invention is to enlarge application of the fabric guide for a sewing machine whereby a couple of the same guides may be employed in combination for properly guiding tapes which may have different widths.

According to the invention there is provided a fabric guide used in combination with a sewing machine having a sewing machine bed of a predetermined width, which comprises an elongated main body made of an elastic material and having both sides providing vertical opposite faces adapted to bridge the sewing machine bed, and hook portions integrally formed with the main body at the opposite ends thereof and terminated in opposite abutments each extending laterally thereof, the opposite abutments normally defining therebetween a predetermined distance a little smaller than the width of the sewing machine bed, which distance may be enlarged due to the elasticity of the main body.

One of the vertical opposite side faces of the main body of the fabric guide may preferably be provided with a pair of walls elongating side by side along the main body and horizontally protruded from the said vertical face.

BRIEF DESCRIPTION OF DRAWINGS

The foregoing and other objects as well as the characteristic features of the invention will be fully understood from the following detailed description when read in conjunction with the accompanying drawings in which.

DESCRIPTION OF PREFERRED EMBODIMENT

Figure 1:
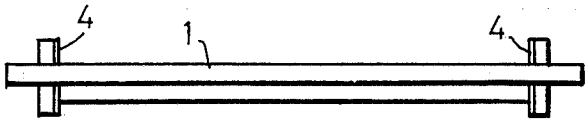
FIGS. 1 and 2 are plan and front views showing a fabric guide embodying the invention.
Figure 2:
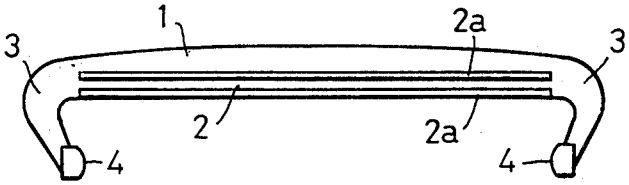
Figure 3:
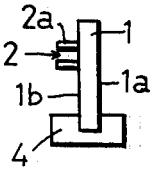
FIG. 3 is a side view of the fabric guide.
Figure 4:
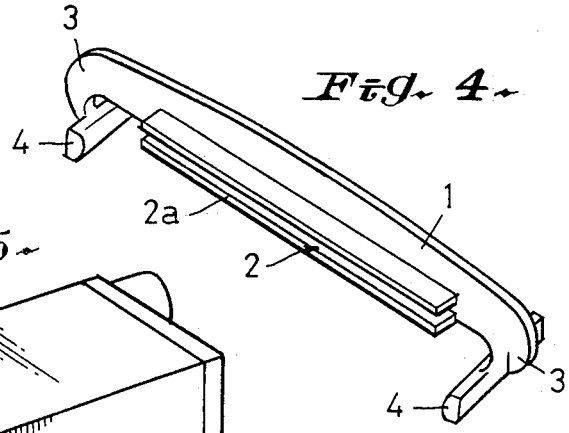
FIG. 4 is an oblique view showing the fabric guide.

Shape and construction of a fabric guide embodying the invention is specifically shown in FIGS. 1–4. More particularly, the guide of the invention comprises in substance an elongated main body 1 made of an elastic material and having both sides providing vertical flat faces l*a*,1*b*, both ends of which are curved down to form integrally therewith hook portions 3. Each of the hook portions 3 is terminated in an abutment or grip 4 elongated in the right-angled direction beneath the main body 1. The opposite abutments or grips 4 are arranged in parallel and define a distance therebetween which is a little smaller than a width of the sewing machine bed B but may be enlarged due to the elasticity of the main body 1 which provides for a flexing of the hook portions 3. Thus, the guide of the present invention is symmetric in the plan and front views as shown in FIGS. 1 and 2. Further, the main body 1 has a pair of laterally elongating walls 2*a* protruded from one of the opposite vertical flat faces 1*a*,1*b*, thus defining a groove 2 therebetween as shown.

In actual stitching operation the above described guide is installed to the sewing machine in such a manner that the main body 1 is bridged across the sewing machine bed B in reference to the needle position (not shown) and in parallel with the fabric feed direction. The elasticity of the guide will assure easy installation and removal thereof with respect to the sewing machine bed B by manually expanding the abutments 4 outwardly to thereby enlarge the distance therebetween. Having been attached to the bed B the guide will remain fixed at the position determined by the opposite abutments 4 pressed against the opposite side walls of the bed B.

Figure 5:
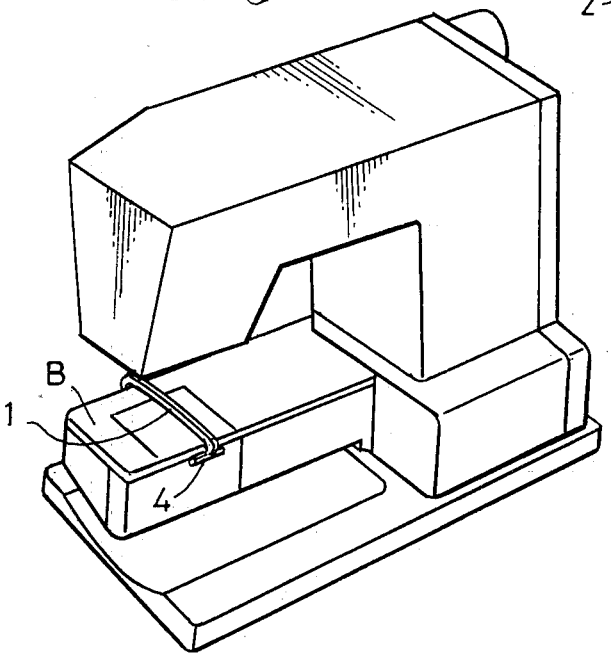
FIG. 5 is an explanatory view showing the fabric guide being attached to a sewing machine bed.
Figure 6:
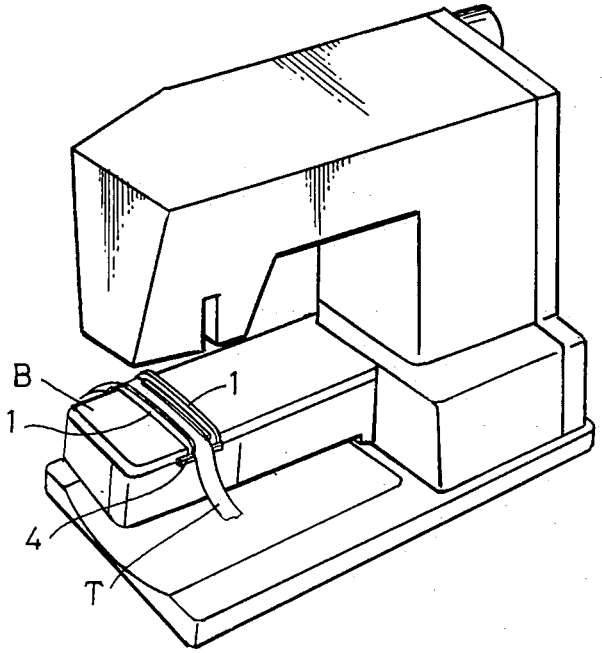
FIG. 6 is an explanatory view showing the fabric guide being used in another manner.
Figure 7:
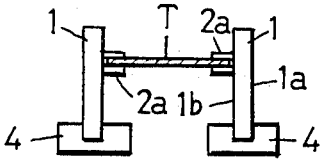
FIG. 7 is a side view showing the fabric guide when being used in the manner shown in FIG. 6.

The fabric guide of the present invention can be employed in different manners to meet various stitching requirements. For example, when the stitches are to be produced along the edge of the fabric the single guide is used as shown in FIG. 5 in which the vertical flat face 1*a*, where there is no groove 2, is directed to the needle position so that the face 1*a* may contact and guide the edge of the fabric as the fabric is transported. Thus, the fabric is properly guided by feed dog (not shown) in the fabric feed direction, while maintaining a predetermined distance between the needle position and the fabric edge. If necessary, the operator may simply slide the guide by hand along the bed B to thereby vary the distance between the needle position and the fabric edge. When stitching a tape T, a pair of the guides of the same shape and construction may be positioned on the sewing machine bed B as shown in FIG. 6 in which two guides of the invention are arranged side by side on both sides of the needle position with a space as required therebetween and with the vertical faces 1*b* on which the grooves 2 are respectively formed being directed to the needle position, so that both edges of the tape T may be received in the opposite grooves 2 of the guides and properly guided just in the predetermined feed direction as the tape is transported.

As described above, the fabric guide of the present invention can be easily installed on the sewing machine bed B and easily detached therefrom. The guide once installed on the sewing machine bed B will always maintain a fixed position to create a guide face capable of properly guiding a fabric in the fabric feed direction, but may be optionally slid along the bed B to provide variation of the distance between the needle position and the fabric edge while maintaining parallelism between the guide and the fabric feed direction. Moreover, the guide of the invention can be used not only alone for guiding the edge of the fabric but also by a pair thereof for properly guiding tapes of different widths.

Although the invention has been described in conjunction with a specified embodiment thereof, it is to be understood that many other variations and modifications may be made without departing from the true spirit and scope of the invention as defined in the appended claims.

What is claimed is:

1. A fabric guide used in combination with a sewing machine having a sewing machine bed of a predetermined width, said fabric guide comprising a main body in a form of an elongated plate made of an elastic material and having opposite faces vertically extended all through the length of said elongated plate, said elongated plate having hook portions integrally formed at the opposite ends lengthwise thereof and terminated in opposite abutments each extended laterally thereof, and normally defining therebetween a predetermined distance a little smaller than the width of said sewing machine bed, said hook portions being operated against the elastic action thereof to enlarge said distance between said opposite abutments to thereby install said fabric guide on said sewing machine bed across said width thereof.

2. The fabric guide according to claim 1, further comprising a pair of walls provided side by side on one of said vertical opposite faces of said elongated plate, said pair of walls protruded laterally of said one face and defining a groove therebetween which is extended substantially all the length of said elongated plate.

* * * * *